United States Patent [19]

Lai et al.

[11] Patent Number: 4,965,412

[45] Date of Patent: Oct. 23, 1990

[54] COAXIAL ELECTRICAL CABLE CONSTRUCTION

[75] Inventors: Vu A. Lai; Carol A. Menefee, both of Austin, Tex.

[73] Assignee: W. L. Gore & Associates, Inc., Newark, Del.

[21] Appl. No.: 334,636

[22] Filed: Apr. 6, 1989

[51] Int. Cl.[5] ..... H01B 11/18

[52] U.S. Cl. ..... 174/107; 174/160 R; 174/106 SC; 174/109; 174/110 FC; 174/110 F

[58] Field of Search ..... 174/110 F, 110 FC, 102 SC, 174/106 R, 106.56, 109, 107

[56] References Cited

U.S. PATENT DOCUMENTS

| | | | |
|---|---|---|---|
| 3,963,854 | 6/1976 | Fowler | 174/106 R X |
| 4,029,889 | 6/1977 | Mizuochi | 174/110 FC X |
| 4,360,704 | 11/1982 | Madry | 174/102 SC X |
| 4,408,089 | 10/1983 | Nixon | 174/106 R |
| 4,472,597 | 9/1984 | Uematsu | 174/106 R X |
| 4,477,693 | 10/1984 | Krabec et al. | 174/106 R X |
| 4,501,928 | 2/1985 | Eshitobi | 174/106 SC X |
| 4,532,375 | 7/1985 | Weitzel et al. | 174/102 SC X |
| 4,642,417 | 2/1987 | Ruthrof et al. | 174/109 X |
| 4,701,576 | 10/1987 | Wada et al. | 174/110 F X |
| 4,725,693 | 2/1988 | Hirsch | 174/106 SC X |

FOREIGN PATENT DOCUMENTS

| | | | |
|---|---|---|---|
| 204410 | 11/1955 | Australia | 174/102 SC |
| 2385194 | 11/1978 | France | 174/106 R |
| 677656 | 8/1952 | United Kingdom | 174/106 R |

*Primary Examiner*—Morris H. Nimmo

*Attorney, Agent, or Firm*—Gary A. Samuels

[57] ABSTRACT

A coaxial electric cable having a significant reduction in weight for equivalent electrical properties provided by wide spacing of braided or served shielding wires under metal foil, metal-laminated, or conductive tape shielding in a porous expanded polytetrafluoroethylene-insulated cable.

1 Claim, 1 Drawing Sheet

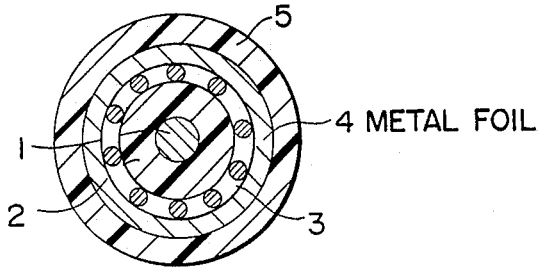
Fig. 1
Fig. 2
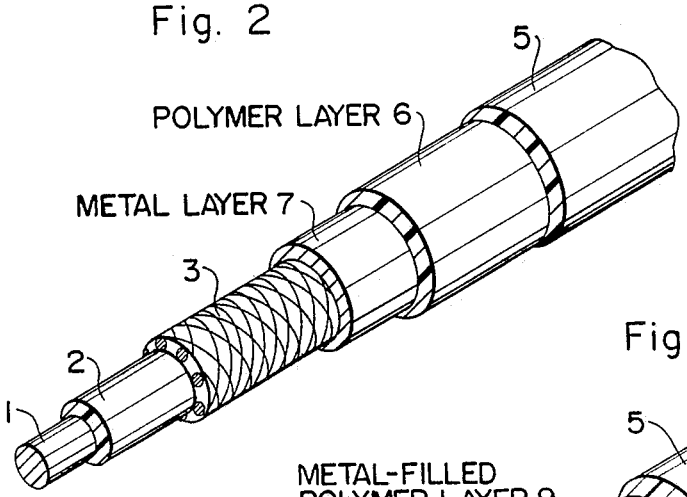
Fig. 3
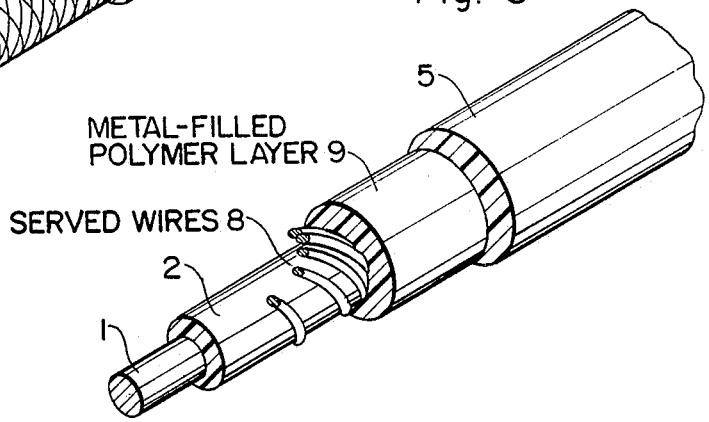

COAXIAL ELECTRICAL CABLE CONSTRUCTION

BACKGROUND OF THE INVENTION

The present invention relates to coaxial electrical cables for transmission of data signals. The cables comprise a metallic center conductor surrounded by insulation, a served or braided metal wire shield, a metal foil or metal-laminated polymer film or metal-filled polymer shield, and a protective polymeric jacket.

Currently, digital data processing and computing systems and other electronic apparatus have become increasingly smaller and lighter in weight, are manufactured to increasingly close tolerances, and have improved physical and electrical characteristics. Reducing the size and/or weight of a system providing the same electrical and mechanical characteristics as a larger and/or heavier system, or improving the mechanical and electrical characteristics while maintaining the same size and/or weight, can confer a considerable advantage in applications where minimum weight and size are important or which may allow the application to be successful. Cables of this type generally comprise a metallic center conductor surrounded by insulation, a served or braided metal wire shield surrounding the insulation, a conductive metal foil or metal-laminated polymer or metal-filled polymer tape-wound shield surrounding the served or braided wire shield, and a polymeric protective outer jacket. In a cable of this type, the served or braided metal wire shielding is generally applied to the insulation surrounding the center conductor at between ninety and one hundred percent coverage of the surface area of the insulation in order to provide a cable having adequate electrical properties.

DESCRIPTION OF THE INVENTION

This invention provides a coaxial electric cable having the advantages over presently known coaxial cables of being smaller and lighter, yet providing the same physical and/or electrical characteristics as larger heavier systems. In contrast to the high surface area coverage generally utilized heretofore, it has been discovered that the same good electrical properties that known cables having high coverage (90% or higher coverage) braided or served wire shield can be obtained by cables having a combination of conductive foil in contact with a lower coverage density of the braided or served wires or lower surface area coverage by the wires than in presently known cables. Much of this layer thus consists of air gaps between braided or served wires. The cable of the invention is also significantly lighter in weight as a consequence of use of less metal in the shielding, a possibly large and important advantage when the inventive cables are used in spacecraft, satellites, and aircraft where extra weight costs heavily.

BRIEF DESCRIPTION OF THE DRAWINGS

FIG. 1 is a cross-section of a cable of the invention embodying braided metal wires in the shielding layer.

FIG. 2 shows a perspective of a cable.

FIG. 3 describes a perspective view of the cable including served metal wire shielding.

DESCRIPTION OF PREFERRED EMBODIMENTS

Referring now to the figures for a fuller description of the cable of the invention. FIG. 1 shows a cross-section of a form of the cable with the various layers exposed to view. The metal center conductor 1 is surrounded by a porous insulative material 2, which is preferably the porous expanded polytetrafluoroethylene as described in U.S. Pat. Nos. 3,953,566, 4,096,227, 3,962,153, and 4,187,390 which fully describe the preferred insulative materials and processes for making them. Other insulative materials could be used for insulation 2, including other porous polymer insulations, but these would not be expected to have as good electrical properties as the preferred insulative materials.

The insulated center conductor 1 is next enclosed by a braided 3 or served 8 metal wire shield, either of which is usually made from silver- or tin-plated copper wires. A braided wire shield 3 is applied to the insulated center conductor by standard wire braiding machinery, but leaving air gaps between wires, as shown in FIG. 2. Prior art wrapping methods usually resulted in about 90% coverage of the surface of the insulation by the wire. It has been found that only about 10% to about 55% coverage of the insulation surface is needed when the cable includes a conductive metal foil or metal-laminated polymer or metal-filled tape wrapped layer wound around the braided wire shield 3 or the served wire shield 8. The metal-laminated polymer tape 4, including metal layer 7 and polymer layer 6, may be aluminized or copper-laminated polyester or porous expanded polytetrafluoroethylene or polyester tape. A conductive metal foil may be used instead of metal layer 7 and polymer layer 6 laminated tape, and may be, but not limited to, aluminum, copper, or copper alloy foil.

Surrounding the shielding layers and providing some physical protection to the cable is a jacket 5, usually extruded or tape wrapped, of a thermoplastic polymer, such as polyvinyl chloride, polyethylene, fluoro polymers, urethane rubber, or rubber, for example.

FIG. 3 depicts a cable having a served wire shield 8 surrounding insulation 2 and center conductor 1, which in turn is surrounded by a metal-filled polymer layer 9 and a jacket 5.

Table 1 below compares equal lengths of cables as to weight per unit length and electrical properties for the length. All samples are the same except for the shielding layer. It is observed that all the cables tested for attenuation, capacitance, and inductance by standard methods commonly used in the cable industry had equivalent electrical properties, but the inventive cable weighed 37% less than standard cables, an advantage in aerospace applications or others where weight for equivalent properties may be important.

TABLE 1

| Cable | 100 Ft. Attenuation (db) @ 400 MHz | Weight of 100 Ft. (pounds) | 100 Ft. Capacitance uF @ 10 KHz | 100 Ft. Inductance uH @ 10 KHz |
|---|---|---|---|---|
| Cable of Invention | −7.385 | 1.026 | 1.564 | 11.20 |
| 90% Braid | −7.897 | 1.59 | 1.574 | 11.28 |
| 90% Braid + | −7.720 | 1.64 | 1.570 | 11.28 |

TABLE 1-continued

| Cable | 100 Ft. Attenuation (db) @ 400 MHz | Weight of 100 Ft. (pounds) | 100 Ft. Capacitance uF @ 10 KHz | 100 Ft. Inductance uH @ 10 KHz |
|---|---|---|---|---|
| Aluminum on Polyester | | | | |

The attenuation measurements were by the HP8753A Network Analyzer, capacitance by HP4262A LCR Meter and inductance by HP4262A LCR Meter, and weight by National Contols, Inc. scale model 3800.

It will be apparent to those skilled in the art that various modifications and changes in methods and materials can be made for manufacturing and using this invention without departing from the scope thereof. the boundaries of which are delineated by the appended claims.

I claim:

1. A coaxial electric cable comprising in order:

(a) a conductive metal center conductor surrounded by a layer of (b) porous expanded polytetrafluoroethylene electrical insulation;

(b) surrounding said insulation a conductive wire shield having widely spaced wires wherein from about 10% to about 55% of the surface of said insulation is covered by said wires;

(c) a wrapped conductive shield which comprises a material selected from the group comprising silver metal-filled polytetrafluoroethylene and carbon-filled polytetrafluoroethylene; and (d) a protective polymeric jacket.

* * * * *